US005741012A

United States Patent [19]

So et al.

[11] Patent Number: 5,741,012

[45] Date of Patent: Apr. 21, 1998

[54] METHOD OF PLAYING A GAME OF SKILL AND CHANCE

[75] Inventors: Bryan So, Torrance; Stephen A. Miller, Rolling Hills Estates; Allan L. Nelson, Torrance, all of Calif.

[73] Assignee: Normandie Casino, Gardena, Calif.

[21] Appl. No.: 814,742

[22] Filed: Mar. 7, 1997

[51] Int. Cl.[6] ..... A63F 1/00

[52] U.S. Cl. ..... 273/292; 273/303; 273/304

[58] Field of Search ..... 273/292, 274, 273/303–306

[56] References Cited

U.S. PATENT DOCUMENTS

| | | | |
|---|---|---|---|
| 5,288,082 | 2/1994 | Marquez | 273/292 |
| 5,411,268 | 5/1995 | Nelson et al. | 273/292 |

OTHER PUBLICATIONS

"9's Up, Harrah's Gaming Guide", Harrah's Lake Tahoe Resort Casino Dec. 1988.

"Califorina Dominoes", Casino Gaming Concepts, Inc., Dec. 1995.

*Primary Examiner*—Benjamin H. Layno

*Attorney, Agent, or Firm*—Bruce A. Jagger

[57] ABSTRACT

A game of skill and chance in which a deck of 34 cards comprising 10 numeric pairs of yellow designed cards, 10—10 through 1—1, and 7 numeric pairs of blue designed cards, 7—7 through 1—1, is used. The highest ranking hand is a specially marked non-numeric yellow pair, followed by yellow numeric pairs 10—10 through 1—1, blue pairs 7—7 through 1—1, and numeric combinations of any color. Each player is dealt a set of 4 cards which the player arranges into subsets of 2 cards each. These hands or subsets are denoted as the front and back hands respectively. The subsets of each player are compared, in turn, front hand to front hand and back hand to back hand, to the corresponding hands of a banker/player. The combined outcome of the comparisons determines the outcome of the round of play as between that player and the banker/player.

8 Claims, 3 Drawing Sheets

PF = PLAYER'S FRONT HAND
BF = BANKER'S FRONT HAND
PB = PLAYER'S BACK HAND
BB = BANKER'S BACK HAND

| PLAYER WINS | TIE (PUSH) | BANKER WINS |
|---|---|---|
| PF > BF<br>PB > BB | PF > BF<br>PB < BB | PF < BF<br>PB < BB |
| PF = BF<br>PB > BB | PF < BF<br>PB > BB | PF = BF<br>PB = BB |
| PF > BF<br>PB = BB | | PF = BF<br>PB < BB |
| | | PF < BF<br>PB = BB |

Fig. 2

METHOD OF PLAYING A GAME OF SKILL AND CHANCE

BACKGROUND OF THE INVENTION

1. Field of the Invention

The present invention relates to a game of chance and skill, and in particular, to such a game which utilizes playing pieces of different values arranged in front and back hands wherein both hands are considered separately, but under the same rules, in determining the outcome of play.

2. Description of Related Art and Other Considerations

Previously it has been proposed to play a game wherein the players each receive a set of cards which they must divide into two hands. See, for example, Nelson et al U.S. Pat. No. 5,411,268. There, two hands were dealt to each player with the second hands being used to break ties between the first hands.

A traditional Korean deck of playing cards includes 20 cards with yellow designs thereon, each of which bears a number. There are two cards which bear the number 10, two which bear the number 9, and so on through two cards which bear the number 1. The cards all have different designs on them so that no two cards have the same design even though they bear the same numbers. Two cards bear special markings which, when taken together, cause them to be designated as the "Golden Pair". It is the markings, and not the numbers, on these cards which cause them to be identified as the "Golden Pair". For example, the "Golden Pair" may bear the numbers "8" and "3". The "Golden Pair" is the highest ranking hand. This traditional deck of cards includes only cards with yellow designs on them. This traditional Korean game provides for the determination of winners first by the "Golden Pair", or, failing that, by numbers, with pairs being higher ranking than other number combinations. Next down in the hierarchy from the "Golden Pair" is the yellow 10 pair, followed by the yellow 9 pair, on down to the yellow 1 pair. Except for the "Golden Pair", yellow cards are determined to be pairs by the numbers that they bear, and not by their designs. Below the yellow pairs is a hierarchy of number combinations running from 9 down to 0. A ten is counted as a zero. Each player is dealt two cards in confidence. After the cards are dealt the wagering begins. No banker is involved so each player plays against all of the others in the game. The designs on the two cards which bear the same number are different. The possible combinations, and the challenge of playing the game, are, therefore, limited.

SUMMARY OF THE INVENTION

These and other problems are successfully addressed and overcome by the present invention wherein at least two players receive equal numbers of playing pieces in confidence from a dealer, which playing pieces are divided, by or at the direction of the respective players, into front and back hands. According to a preferred embodiment of the invention, the traditional Korean deck of 20 yellow design cards is used but it is augmented with 14 additional cards of a different color, for example, blue. The game which is played with this modified deck of 34 cards, according to the present invention, is identified herein and in the claims appended hereto as "Modified Pairs". The highest ranking hand is the "Golden Pair". Special rules are provided which govern the interaction between the two hands, and the inclusion of 14 extra cards.

One of the players is designated, for a particular round of play, as a banker/player. The banker/player status preferably rotates amongst the players between rounds of play so that all players eventually have the opportunity to act as the banker/player. The other players play, each in turn, against the banker/player. Generally, wagers are placed, and the banker/player indicates the total amount which he is willing to risk, before the playing pieces are dealt. The action player, that is, the player who will play first against the banker/player, is selected for each round of play by some suitable random method such as, for example, throwing dice. Playing pieces are dealt by a dealer to all of the players in confidence. The players arrange their cards into separate hands. The dealer then exposes the banker/player/player's playing pieces and arranges them according to the banker/player/player's directions.

The hands of the players are compared, each in turn, to the hands of the banker. The front hand of the first player is compared to the front hand of the banker/player/player, and the back hand of the first player is compared to the back hand of the banker/player/player. The comparisons of both the front and back hands are considered in determining the outcome. Play is concluded between the first player and the banker before play between the banker/player and the second player is commenced. The outcome may be a tie (push) in which no winner is declared. If the outcome is not a tie, then either the banker/player or the player wins. The rules by which the hands are compared are preferably established so that the banker/player has a slight advantage.

Preferably, there are from two to eight players, one of whom is designated the banker/player against whom the others play, and a separate dealer who administers the game. Preferably, the dealer is not a player. Preferably, each player receives four playing pieces which are divided into front and back hands with two pieces in each hand. If the front hand of any player is higher than that player's back hand, that player automatically loses without regard to any other factors. The terms "front" and "back", with respect to the hands, are used to differentiate between the two hands, not to indicate that one hand is necessarily in a physical location which is in front of or in back of the other. The hands could, for example, be placed side-by-side and still be described as being the "front" and "back" hands.

The banker/player designation preferably rotates among all of the players according to some predetermined order, for example, the banker/player designation may rotate clockwise after every second round of play. Each player has the option of declining to be the banker/player. The position of dealer preferably does not rotate.

The rules for the play of "Modified Pairs" by which the hands of the respective players and the banker/player are compared are preferably established so that the same rules are applied to determining the order of prevalence of both the front and the back hands.

According to the present invention, for the play of "Modified Pairs" a series of 14 blue cards in seven numeric pairs is added in the hierarchy of values between the yellow 1 pair and the number combinations of the above described traditional Korean game. The deck thus consists of 34 cards. This considerably expands the challenge and excitement of playing the game. As between blue and yellow, yellow cards are the highest ranking. The numeric values of the blue cards range from 7 to 1. Pairs can not be made up from different colored cards. The combination, for example, of a yellow 7 and a blue 7 does not make a pair. Such a combination has a value of 4, with any value above 9 being disregarded. A yellow pair prevails over a blue pair of any numeric value. Thus, the yellow pair, 1—1, prevails over the blue pair, 7—7. Pairs prevail over other number combinations. Thus, the blue pair 1— 1, prevails over a hand consisting of yellow 5 and yellow 4. Number combinations, other than pairs, can be made up of different colored cards. A hand consisting of a yellow 4 and a blue 5, for example, is ranked as a 9. A hand consisting of a blue 2 and a yellow 10 is ranked as a 2 because the 10 is counted as 0. The highest number combination permitted is 9. When a number combination goes over 9 the first digit is disregarded and the hand is valued at the value of the second digit. Thus, a numeric combination hand consisting of 5-6 is valued at 1, a hand of 9-8 is valued at 7, and a hand of 7-8 is valued at 5. As will be understood by those skilled in the art, other ranking systems may be employed, for example, the yellow cards could be assigned more significance that the blue cards in number combinations so that a hand with a yellow 5 and a yellow 4 would outrank a hand with a blue 5 and a blue 4, and the like. Other card systems with established ranking methods which are well known to those skilled in the art, while less preferred, can also be employed, if desired.

Other aims and advantages, as well as a more complete understanding of the present invention, will appear from the following explanation of exemplary embodiments and the accompanying drawings thereof.

BRIEF DESCRIPTION OF THE DRAWINGS

FIG. 2 is a chart which shows a preferred system, according to the present invention, for considering the effect of the comparisons of the front and back hands in determining the outcome of a round of play of "Modified Pairs".

DETAILED DESCRIPTION OF THE PREFERRED EMBODIMENTS

Figure 1:
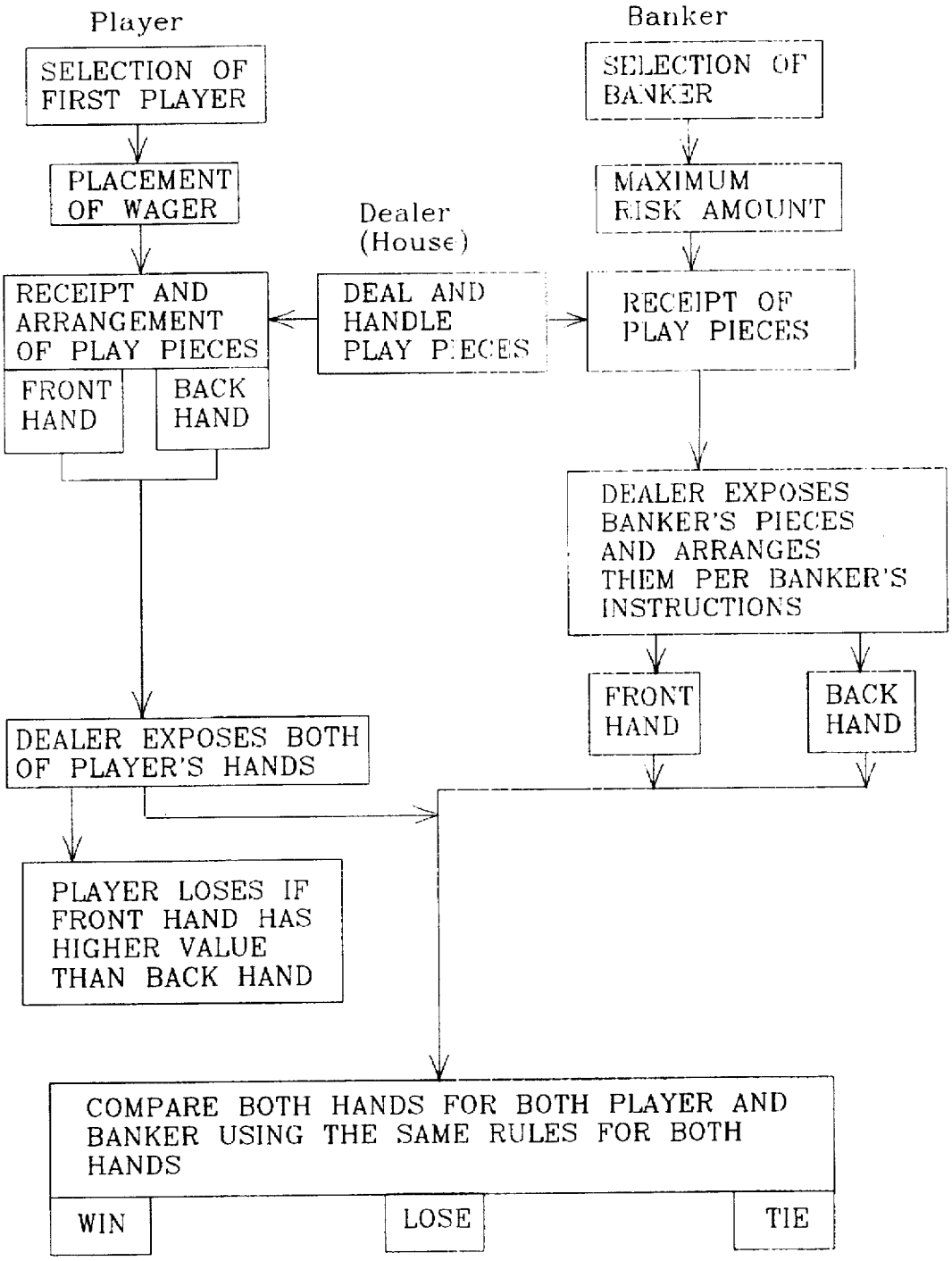
FIG. 1 is diagram which shows a preferred sequence for one round in the play of a game according to the present invention.

Referring particularly to the drawings for purposes of illustration and not limitation, there is illustrated in FIG. 1 a typical sequence of play for a game of Modified Pairs in which there is an independent dealer, a banker/player and a player. Where a particular round of play involves two or more players, all of the players go through the steps illustrated in FIG. 1 down to the step where that player's playing pieces are arranged into front and back hands, comprising subsets of the cards dealt to them, before the dealer exposes the banker/player's pieces. The step where the "Dealer Exposes Both Of Player's Hands" is carried out in turn for each player beginning with the action (first) player. All of the steps following the arrangement of a player's front and back hands are carried out to the final outcome of play between that player and the banker/player before the next player's hands are considered. A round of play ends when all of the players have had a chance to play against the banker/player, or the banker/player loses all of the "Maximum Risk Amount", whichever comes first. If the banker/player loses all of the amount which he was willing to risk ("Maximum Risk Amount") before a player gets to play against the banker/player, that player simply keeps what he wagered. The sequence of the selection of banker/player and first player, and the placement of wager and declaration of maximum risk amount, may be inverted, if desired.

All of the playing pieces which comprise the full set of pieces furnished to the banker/player or a player may be furnished one piece at a time in rotation, or all of one set of playing pieces may be dealt to a player at one time. Preferably, each player is dealt one piece in turn before any player receives a second piece. In general, the playing pieces are preferably cards, although, as will be understood by those skilled in the art, other playing pieces may be used, if desired.

Preferably, the separation of the set of playing pieces into the subsets which comprise the respective hands of a player is physically accomplished by the player. That is, the player handles the pieces and separates them into subsets. The banker/player's hand is preferably treated somewhat differently. Preferably, the banker/player does not touch the playing pieces at all. The dealer exposes the banker/player's set of playing pieces and the banker/player verbally directs the dealer how to arrange the pieces in the banker/player's set of playing pieces into subsets or hands. In any event, the players and the banker/player are responsible for separating their playing pieces into subsets or hands.

When the front and back hands of the banker/player and a player have been compared, the outcome between the banker/player and the player for that round of play is determined, for example, by the chart shown in FIG. 2. The outcome is a tie if, for example, the player's front hand prevails over the banker/player's front hand (PF>BF) and the banker/player's back hand prevails over the player's back hand (PB<BB). The banker/player is given a slight edge in that if the two hands are equal (PF=BF, and PB=BB), the banker/player wins. As will be understood by those skilled in the art, other weightings could be given to the respective hands. Thus, although less preferred, the front hand could, for example, be given more weight than the back hand so that the winner of the front hand would prevail over the winner of the back hand, and where both hands are equal the outcome could be a tie, and the like.

Figure 3:
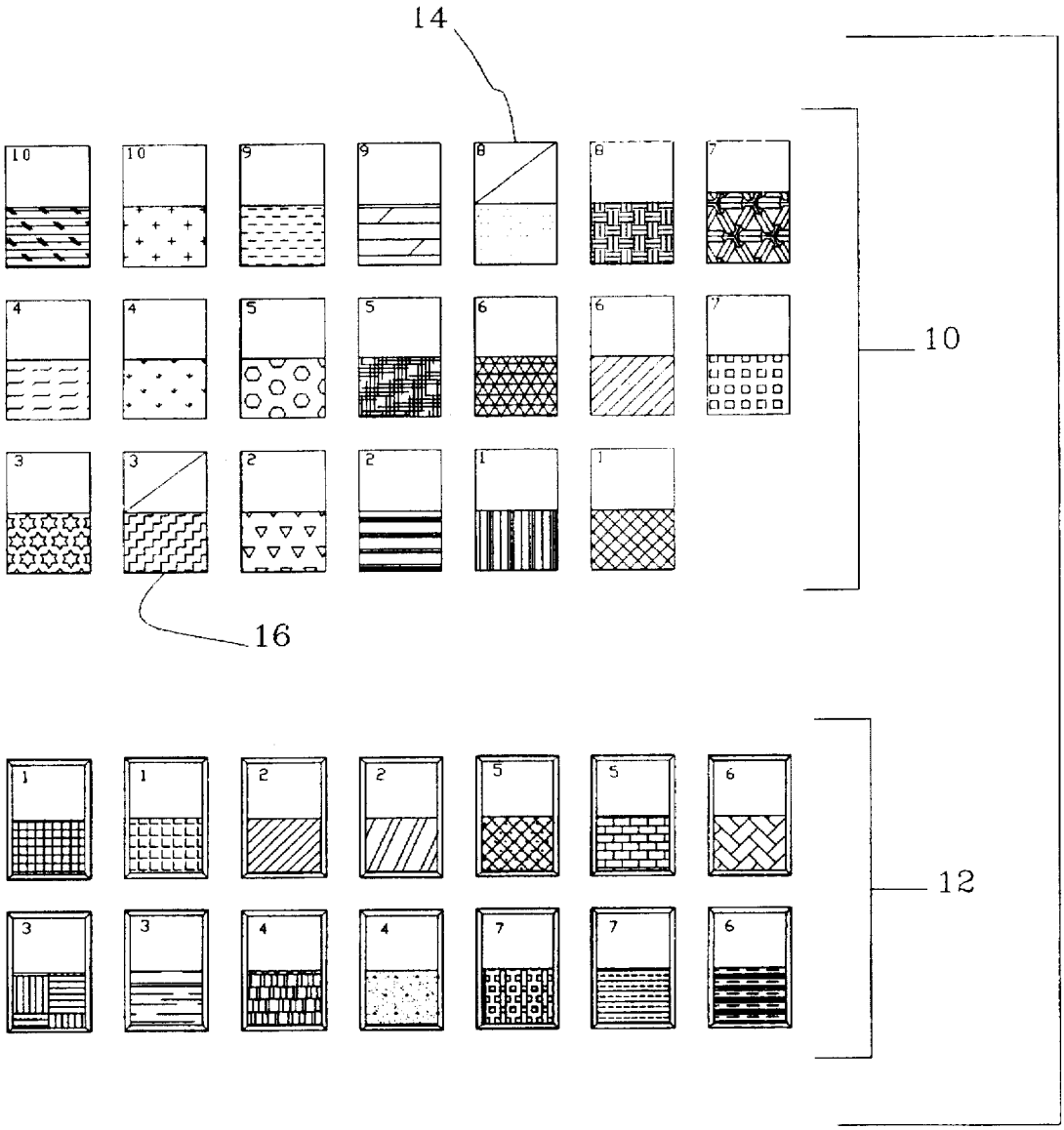
FIG. 3 illustrates the faces of 34 playing cards which comprise a full deck according to the present invention.

A full deck of 34 playing cards is illustrated in FIG. 3. The cards of a first color are illustrated at 10, and those of a second color are illustrated at 12. The "Golden Pair" is illustrated at 14 and 16.

The invention may be practiced using computer hardware and software so that one or more of the dealer, the banker/player, or one or more of the other players may be a computer simulation. The playing pieces may be electronic artifacts displayed on a monitor rather than physical objects.

As will be understood by those skilled in the art, alternative, supplemental or additional steps and methods may be utilized within the scope of the invention. Although, as required, the invention has been described with respect to particular embodiments thereof, it should be realized that various changes and modifications may be made therein without departing from the spirit and scope of the invention.

What is claimed is:

1. A method of playing a game of chance by a dealer, a banker/player and at least one other player, comprising the steps of:

utilizing a deck of 34 playing cards including 10 numeric pairs of a first color having individual designs and values within the range of 10—10 to 1—1, a pair of cards of said first color bearing special markings distinguishing said pair of cards from all the remaining playing cards, and 7 numeric pairs of a second color having individual designs and values within the range of 7—7 to 1—1, which, in combination, are capable of establishing an order of prevalence that enables a selection of one set of the playing cards to win over another selection of another set of the playing cards;

furnishing a first randomly selected set of the playing cards to a player whose responsibility is to separate the first randomly selected set into front and back hands comprising subsets of the first randomly selected set;

furnishing a second randomly selected set of the playing cards to a banker/player whose responsibility is to separate the second randomly selected set into front and back hands comprising subsets of the second randomly selected set;

comparing the front hand of the player to the front hand of the banker/player using predetermined rules of prevalence to determine a winner or a tie therebetween, and comparing the back hand of the player with the back hand of the banker/player using said predetermined rules of prevalence to determine a winner or a tie therebetween, said predetermined rules comprising that the highest ranking hand is a pair of said first color bearing special markings, followed by numeric pairs of said first color, numeric pairs of said second color, and numeric combinations of any color;

declaring the game a tie if the banker/player wins on one hand and loses on the other hand;

declaring the player the winner if the player wins on both hands or wins on one hand and is equal to the banker/player on the other hand; and otherwise, declaring the banker/player the winner.

2. A method according to claim 1 including furnishing said randomly selected sets one playing card at a time in rotation, whereby all players receive a first playing card before any player receives a second playing card.

3. A method according to claim 1 including furnishing said randomly selected sets more than one playing card at a time, whereby the first player receives more than one playing card before the second player receives any playing cards.

4. A method according to claim 1, requiring a minimum of four persons, further comprising the steps of:

naming one of the persons as the provider of said furnishing steps, and the remaining persons as players;

selecting a remaining person as the banker/player; and randomly selecting a first of the remaining persons as the first player.

5. A method according to claim 1 including furnishing a third randomly selected set of the playing pieces to a third party.

6. A method according to claim 1 including furnishing a plurality of randomly selected sets of the playing pieces to a plurality of other players, each said other player having the responsibility to separate the set of playing pieces so received into front and back hands comprising subsets of the sets.

7. A method according to claim 1 including using predetermined rules of prevalence wherein a pair of cards of said first color prevails over a pair of cards of said second color.

8. A method according to claim 1 including utilizing the same predetermined rules to compare the first hands and the second hands.

* * * * *